US012655596B2

(12) United States Patent
Watts

(10) Patent No.: US 12,655,596 B2
(45) Date of Patent: Jun. 16, 2026

(54) SCREW PILE DRIVING APPARATUS

(71) Applicant: Collin Watts, Red Deer (CA)

(72) Inventor: Collin Watts, Red Deer (CA)

( * ) Notice: Subject to any disclaimer, the term of this patent is extended or adjusted under 35 U.S.C. 154(b) by 258 days.

(21) Appl. No.: 18/475,719

(22) Filed: Sep. 27, 2023

(65) Prior Publication Data

US 2024/0110356 A1 Apr. 4, 2024

Related U.S. Application Data

(60) Provisional application No. 63/413,024, filed on Oct. 4, 2022.

(51) Int. Cl.
*E02D 7/22* (2006.01)
*E02D 13/04* (2006.01)

(52) U.S. Cl.
CPC ..... *E02D 7/22* (2013.01); *E02D 13/04* (2013.01); *E02D 2600/10* (2013.01)

(58) Field of Classification Search
CPC .... E02D 7/02; E02D 7/06; E02D 7/14; E02D 7/16; E02D 7/22; E02D 13/04
See application file for complete search history.

(56) References Cited

U.S. PATENT DOCUMENTS 3,200,599 A 8/1965 Phares et al.
4,433,943 A 2/1984 Chen
5,967,700 A 10/1999 Gunther
6,238,142 B1 5/2001 Harsch
6,478,512 B2 11/2002 Sherwood
7,228,920 B2 * 6/2007 Harthauser ..... E21B 3/022 175/57
8,322,458 B2 12/2012 Stoetzer et al.
(Continued)

FOREIGN PATENT DOCUMENTS

AU 2002217433 A1 * 6/2003 ..... E21B 7/021
AU 2022361945 A1 * 5/2024 ..... E02D 7/22
(Continued)

OTHER PUBLICATIONS

Spagnoli, et al., Helical Piles as a Novel Foundation System for Offshore Piled Facilities, Society of Petroleum Engineers, SPE-177604-MS, Nov. 2015, pp. 1-12, Abu Dhabi International Petroleum Exhibition and Conference Held in Abu Dhabi, UAE Nov. 9-12, 2015.

*Primary Examiner* — Frederick L Lagman
(74) *Attorney, Agent, or Firm* — Ryan W. Dupuis; Kyle R. Satterthwaite; Ade & Company Inc.

(57) ABSTRACT

A screw pile driving apparatus is supported on the boom of a work vehicle. A mast of the apparatus is adjustable relative to the work vehicle. A carriage slidable along the mast carries a rotary driver that releasably mounts the screw pile thereon. The bottom end of the mast includes an element penetrated into the ground and an adjustment mechanism that allows repositioning of the mast relative to that element prior to leveling of the mast and driving the pile into the ground as the carriage is displaced along the mast. The mast and carriage guide the rotary driver as a screw pile is penetrated into the ground to maintain the screw pile vertical. Allowing adjustment of the bottom of the mast relative to the ground also allows the mast to be precisely located relative to the target location for the pile before the pile is penetrated into the ground.

19 Claims, 7 Drawing Sheets

(56) References Cited

U.S. PATENT DOCUMENTS

| | | | | |
|---|---|---|---|---|
| 10,954,645 | B2 * | 3/2021 | DeBlauw | E02D 7/10 |
| 11,168,456 | B2 * | 11/2021 | Kraft | E02D 5/801 |
| 12,331,479 | B2 * | 6/2025 | Kraft | E02D 5/56 |
| 2020/0283981 | A1 * | 9/2020 | Shevtsov | E02D 7/08 |
| 2021/0230942 | A1 * | 7/2021 | Heichel | E02D 7/14 |
| 2022/0064892 | A1 * | 3/2022 | Kraft | E02D 5/56 |
| 2022/0274818 | A1 * | 9/2022 | Linley | B66F 9/08 |

FOREIGN PATENT DOCUMENTS

| | | | | |
|---|---|---|---|---|
| AU | 2022372965 | A1 * | 5/2024 | E02D 7/22 |
| CN | 112761148 | A * | 5/2021 | E02D 7/06 |
| CN | 114790738 | A * | 7/2022 | E21B 15/04 |
| IT | 202000019597 | A1 * | 2/2022 | E02F 5/20 |

* cited by examiner

SCREW PILE DRIVING APPARATUS

This application claims the benefit under 35 U.S.C. 119(e) of U.S. provisional application Ser. No. 63/413,024, filed Oct. 4, 2022.

FIELD OF THE INVENTION

The present invention relates to a screw pile driving apparatus which can be supported on the boom of a work vehicle for driving a screw pile into the ground.

BACKGROUND

Piles are known to be penetrated into the ground to support various static structures including buildings and the like. Two common types of piles include driven piles and screw piles.

Driven piles typically have a continuous cylindrical outer surface which is retained in place primarily by friction between the outer surface and surrounding soil. These piles are typically penetrated into the ground using pile driving equipment in the form of an elongate mast supporting a reciprocating head thereon which repeatedly impacts the pile to pound the pile into the ground. Screw piles cannot be penetrated into the ground using a reciprocating head as to do so would damage the screw pile.

Screw piles typically comprise an elongate shaft supporting helical flighting thereon forming a screw which is driven into the ground by rotating the screw pile. These piles are typically driven into the ground using a rotary head which is freely suspended from an excavator boom so that the upper end of the screw pile is fixed to the rotary output of the rotary head to be freely suspended vertically from the rotary head on the boom. As the screw pile is driven into the ground, a high level of operator skill is required to lower the boom of the excavator with the screw pile while maintaining vertical alignment of the screw pile. Due to the pivoting nature of the joints in the excavator boom, it is difficult to ensure the rotary head follows a true vertical path as the screw pile is driven into the ground, resulting in screw piles being potentially guided into the ground at an inclination offset from a true vertical axis. Furthermore, due to the screw pile hanging freely from the rotary head, minor obstacles such as rocks and the like can cause the pile to be easily deflected off target as the pile is initially driven into the ground.

SUMMARY OF THE INVENTION

According to one aspect of the invention there is provided a screw pile driving apparatus for use with a boom of a work vehicle for driving a screw pile into ground for receiving the screw pile, the apparatus comprising:

(i) a mounting arrangement arranged for releasable attachment to the boom of the work vehicle;

(ii) a mast supported on the mounting arrangement so as to be arranged to be vertically oriented when supported on the work vehicle;

(iii) a carriage supported for sliding movement along a longitudinal axis of the mast; and (iv) a rotary driver supported on the carriage for movement along the mast with the carriage, the rotary driver having a rotary output arranged to be releasably coupled to the screw pile for driving rotation of the screw pile relative to the ground.

According to a second aspect of the present invention there is provided a method of installing a screw pile into ground for receiving the screw pile, using the screw pile driving apparatus described above supported on the boom of the work vehicle, the method further comprising: (i) positioning the carriage in proximity to a bottom end of the mast; (ii) coupling the screw pile to the carriage; (iii) raising the carriage to suspend the screw pile therefrom in a vertical orientation alongside the mast; (iv) locating the screw pile over a target location on the ground; (v) engaging a bottom end portion of the mast with the ground; (vi) lowering the carriage until a bottom end of the screw pile engages the ground at the target location; and (vii) driving rotation of the screw pile using the rotary driver to drive the screw pile into the ground up to a desired penetration depth of the screw pile. The method may further include adjusting position of the mast relative to the bottom end portion of the mast about at least one translating axis oriented perpendicularly to the longitudinal axis of the mast to realign the screw pile over the target location prior to the step of lowering the carriage until a bottom end of the screw pile engages the ground at the target location.

The use of a mast and a carriage movable along the mast for guiding the rotary driver as a screw pile is penetrated into the ground maintains a true vertical alignment of the screw pile throughout the installation process. Furthermore, the pivotal connection between the mast and the mounting arrangement that secures the mast to the boom of the work vehicle together with the adjustability of the boom of the work vehicle enables the mast to be adjusted to a true vertical orientation before penetration of the pile into the ground. Yet further providing a bottom end portion of the mast that can engage the ground and relative to which the mast can be translated about one or two axes, also allows the mast to be precisely located relative to the target location for the pile before the pile is penetrated into the ground.

The apparatus may further comprise (i) a tilt pivot coupling the mast pivotally relative to the mounting arrangement about a lateral tilt axis whereby inclination of the mast can be adjusted within a first plane perpendicular to the lateral tilt axis, and (ii) a tilt actuator operatively connected between the mounting arrangement and the mast to controllably adjust the inclination of the mast relative to the mounting arrangement about the lateral tilt axis.

The apparatus may be further configured such that (i) the mounting arrangement is arranged to be mounted on a bucket mount of the work vehicle that is pivotal about a bucket axis relative to the boom, (ii) the mounting arrangement is arranged to be secured to the bucket mount so as to be pivotal with the bucket mount relative to the boom about the bucket axis, and (iii) the mounting arrangement orients the lateral tilt axis of the mast perpendicularly to the bucket axis.

When the mounting arrangement is arranged to be mounted on a bucket mount of the work vehicle that is pivotal about a bucket axis relative to the boom, the mounting arrangement may be further arranged to be secured to the bucket mount so as to be pivotal with the bucket mount relative to the boom about the bucket axis in which the mounting arrangement supports the mast to be laterally offset from the bucket mount in a direction of the bucket axis.

A ground spike may be mounted at a bottom end of the mast such that the ground spike is arranged to be penetrated into the ground to secure the bottom end of the mast relative to the ground.

A coupling arrangement may support the ground spike on the bottom end of the mast such that the ground spike is adjustable relative to the mast along at least one translating axis oriented perpendicularly to the longitudinal axis of the mast. More particularly, said at least one translating axis may comprise two translating axes oriented perpendicularly to one another. The coupling arrangement may also include a translating actuator associated with said at least one translating axis in which the translating actuator is arranged to displace the ground spike in either one of two opposing directions along the translating axis from a neutral position of the ground spike relative to the mast.

The apparatus may further include a carriage driver arranged to drive upward movement of the carriage along the mast when the screw pile is supported on the carriage in which the carriage driver includes a neutral position enabling free movement of the carriage relative to the mast when the screw pile is driven into the ground using the rotary driver.

The carriage driver may comprise (i) a driven chain in the form of an endless loop in operative connection between an upper gear rotatably supported in proximity to a top end of the mast and a lower gear rotatably supported in proximity to a bottom end of the mast, and (ii) a drive motor operatively connected to one of the upper gear, the lower gear or the driven chain to drive rotation of the driven chain about the upper and lower gears, wherein (iii) the carriage is coupled to the driven chain for movement of the carriage along the mast together with rotation of the driven chain about the upper and lower gears.

A pickup arrangement may be supported for movement along the mast, in which the pickup arrangement is arranged to clamp onto the screw pile independently of the rotary output of the rotary drive such that the screw pile is movable along the mast together with the pickup arrangement. The pickup arrangement may be supported on the carriage so as to be movable along the mast together with the carriage. Preferably, the pickup arrangement is slidable relative to the carriage in a sliding direction parallel to the longitudinal axis of the mast, in which the pickup arrangement further comprises a lift actuator arranged to lift the pickup arrangement relative to the carriage.

The pickup arrangement may comprise a pickup arm arranged to coupled in fixed relation to the screw pile, in which the pickup arm is pivotal about a laterally oriented pickup axis relative to the carriage so as to be movable between a first position arranged to be coupled to the screw pile in a horizontal orientation of the screw pile and a second position arranged to be coupled to the screw pile in a vertical orientation of the screw pile.

Preferably the pickup arrangement comprises a pickup actuator arranged to drive displacement of the pickup arm from the first position to the second position.

The apparatus may further include a set of legs supported on the mast and protruding in a common lateral direction from the mast at spaced apart positions along the mast so as to be arranged to support the mast for storage extending along the ground at a location spaced upwardly from the ground when the legs are engaged upon the ground. The common lateral direction that the legs protrude from the mast may be diametrically opposite from the mounting arrangement relative to the longitudinal axis of the mast.

An inclination sensor arrangement may be supported on the mast and arranged to indicate to an operator an inclination of the mast relative to a vertical axis about two inclination axis oriented perpendicular to one another and the vertical axis.

The mounting arrangement may be arranged to support a rear side of the mast facing the work vehicle, in which the carriage is supported on the mast so as to be laterally offset to one side of the mast in an offset direction oriented transversely to an imaginary horizontal axis extending from the rear side to a front side of the mast.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
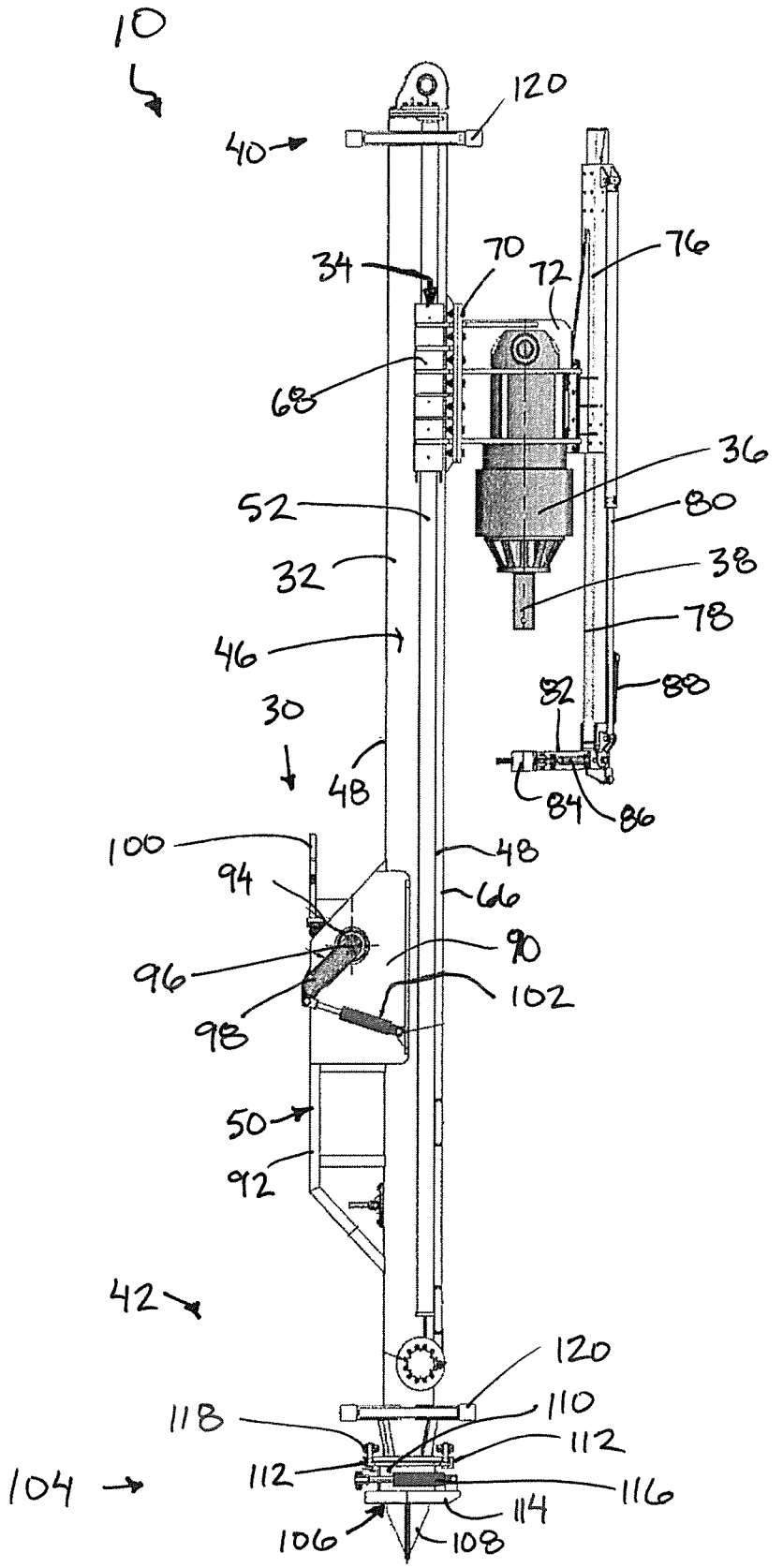
FIG. 1 is a front elevational view of the screw pile driving apparatus in an upright working orientation.
Figure 2:
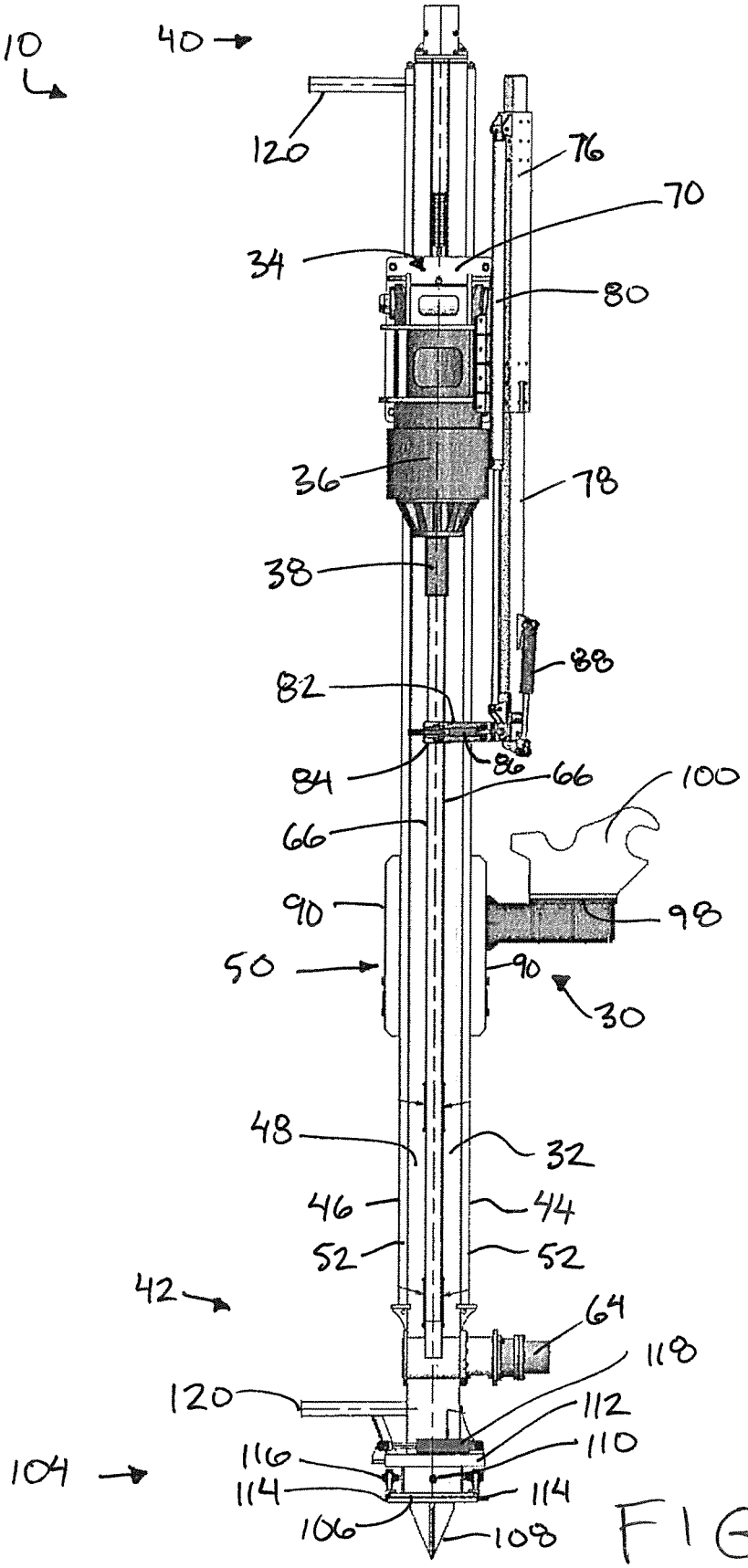
FIG. 2 is a side elevational view of the screw pile driving apparatus.

Referring to the accompanying figures, there is illustrated a screw pile driving apparatus generally indicated by reference numeral 10. The apparatus 10 is particularly suited for driving a screw pile 12 into ground using a work vehicle such as an excavator 14.

A typical excavator 14 for use with the present invention generally includes (i) a tracked undercarriage 16 comprising an undercarriage frame supported for movement along the ground on suitable tracks, (ii) a house 18 including a corresponding frame supporting an operator cab, a drive motor, and a hydraulic system in which the house 18 is pivotal relative to the undercarriage 16 about a vertical pivot axis, and (iii) a knuckled boom assembly that typically supports an excavator bucket (not shown) thereon so as to be movable by the boom assembly for performing various operations of the excavator. More particularly, the boom assembly includes (i) a primary boom 20 that is pivoted at an inner end on the frame of the house 18 about a first horizontal axis, (ii) an arm 22 or stick that is pivoted at the outer end of the boom about a second horizontal axis, and a bucket mount 24 that is pivoted on the outer end of the arm 22 about a third horizontal axis onto which the excavator bucket can be releasably mounted. The bucket mount 24 includes a set of first couplers which are arranged to releasably mate with corresponding second connectors on the excavator bucket to releasably attach the bucket to the bucket mount.

The excavator further includes a plurality of hydraulic actuators operated by the hydraulic system of the excavator for driving operation of the various components of the excavator including relative pivotal movement about each of the defined pivot axes. This includes a bucket actuator 26 operatively connected between the arm 22 and the bucket mount 24 for controlling angular orientation of the bucket mount 24 about the third horizontal axis. The hydraulic system further includes a plurality of auxiliary output circuits which can be connected to various hydraulic motors or actuators of the pile driving apparatus 10 in which operator controls within the cab of the excavator permit control of the flow of hydraulic fluid within the auxiliary output circuits connected to corresponding motors and actuators of the apparatus for controlling operation of the apparatus 10 using operator controls within the cab of the excavator 14.

The apparatus 10 generally includes (i) a mounting arrangement 30 that is arranged for releasable attachment to the bucket mount 24 at the end of the boom assembly of the excavator, (ii) a mast 32 which is supported on the mounting arrangement so as to be arranged to be oriented in a vertical orientation to define the vertical path along which the screw pile is driven during installation of the screw pile into the ground, (iii) a carriage 34 supported for longitudinal sliding movement along a longitudinal axis of the mast 32 so as to be movable vertically in the operating or working orientation of the apparatus, and (iv) a rotary driver 36 supported on the carriage 34 for movement with the carriage along the mast in which the rotary driver 36 has a rotary output 38 arrange to be coupled to the top end of the screw pile 12 such that the rotary output and the screw pile must rotate together for driving rotation of the screw pile into the ground.

The rotary driver 36 comprises a hydraulically driven rotary motor that is supported on the carriage such that the rotary output 38 of the motor rotates about an output axis that is oriented parallel to a longitudinal axis of the mast in a working orientation. The rotary driver 36 is connected to the hydraulic system of the work vehicle for operation by the operator of the work vehicle as described above.

The mast 32 comprises an elongated rigid frame having a longitudinal axis extending between a top end 40 and a bottom and 42 of the mast. In the illustrated embodiment, the mast is a tubular structure of rectangular cross-section which is arranged to be supported by the mounting arrangement on the boom of the excavator such that a rear wall 44 of the mast faces rearwardly towards the operator cab of the excavator while an opposing front wall 46 faces forwardly and away from the operator cab of the excavator. The mast further includes first and second side walls 48 connected between the front wall and the rear wall at laterally opposing sides so as to be parallel and spaced apart from one another.

A mounting frame 50 forming part of the mounting arrangement 30 that supports the mast on the boom of the excavator is mounted primarily on one of the side walls 48 of the mast to protrude laterally outwardly to one side of the mast in a first lateral direction that is generally horizontal and perpendicular to a forward direction of the apparatus. The forward direction of the apparatus as described herein is defined by an imaginary axis extending forwardly from the rear wall 44 to the front wall 46 of the mast within a plane perpendicular to the longitudinal axis of the mast.

The mast 32 further supports a pair of rails 52 thereon in which each rail comprises an elongate rigid frame member protruding from a respective one of the front and rear walls 46 and 44 of the mast. The rails 52 define respective tracks upon which the carriage 34 can be supported for longitudinal sliding along the rails in the longitudinal direction of the mast.

A drive assembly for driving movement of the carriage 34 along the mast includes an upper gear 54 rotatably supported about an upper axis at the top end of the mast and a lower gear 56 rotatably supported about a lower axis in proximity to the bottom end of the mast. The upper and lower axes are oriented parallel to said forward direction extending between the rear and front sides of the mast. The drive assembly further includes a driven chain 58 in the form of an endless loop supported about the upper and lower gears in meshing engagement with the gears such that rotation of the gears drives rotation of the driven chain 58 relative to the mast.

The upper and lower gears are positioned partly within the boundaries of the mast and support the drive chain thereon such that an inner run 60 of the chain is connected between the upper and lower gears within the hollow interior of the mast while an outer run 62 of the drive chain extends along a second side of the side walls 48 of the mast externally of the mast. The outer run of the drive chain is thus supported along the second side wall of the mast which is diametrically opposite from the protruding mounting frame 50 that forms part of the mounting arrangement 34 mounting onto the boom of the excavator. A drive motor 64 in the form of a hydraulic motor is directly coupled to the lower gear 56 to drive rotation of the lower gear which in turn drives rotation of the drive chain relative to the mast for driving longitudinal displacement of the carriage 34 along the mast when the carriage is coupled to the outer run 62 of the drive chain. A pair of protruding guard flanges 66 extend laterally outwardly from the second one of the side walls 48 of the mast at positions located forwardly and rearwardly of the outer run 62 of the drive chain respectively to provide a guiding channel that locates and protects the outer run 62 of the drive chain for longitudinal displacement within the channel defined between the guard flanges 66.

The drive motor 64 is operatively connected to a respective output circuit of the hydraulic system of the excavator such that the drive motor can be operated using operator controls within the excavator. In an alternative arrangement, the drive motor may be an electric motor which may be driven by a controllable electrical output of the excavator.

The carriage 34 includes a carriage frame having two follower portions 68 at diametrically opposing sides of the mast in which each follower portion is a generally U-shaped channel open inwardly towards the opposing follower portion so that the two follower portions receive the two rails 52 of the mast therein respectively. Interior surfaces of the follower portions 68 may be lined with a suitable bushing material to form bearing surfaces which mate for longitudinal sliding along the exterior surfaces of the rails 52 respectively.

The frame of the carriage 34 further includes a bridge portion 70 extending across the second side of the mast 32 between the two follower portions 68 at the front and rear sides of the mast respectively so that the bridge portion 70 is connected between the follower portions 68 in a generally U-shaped configuration extending partway about the circumference of the mast 32.

Figure 3:
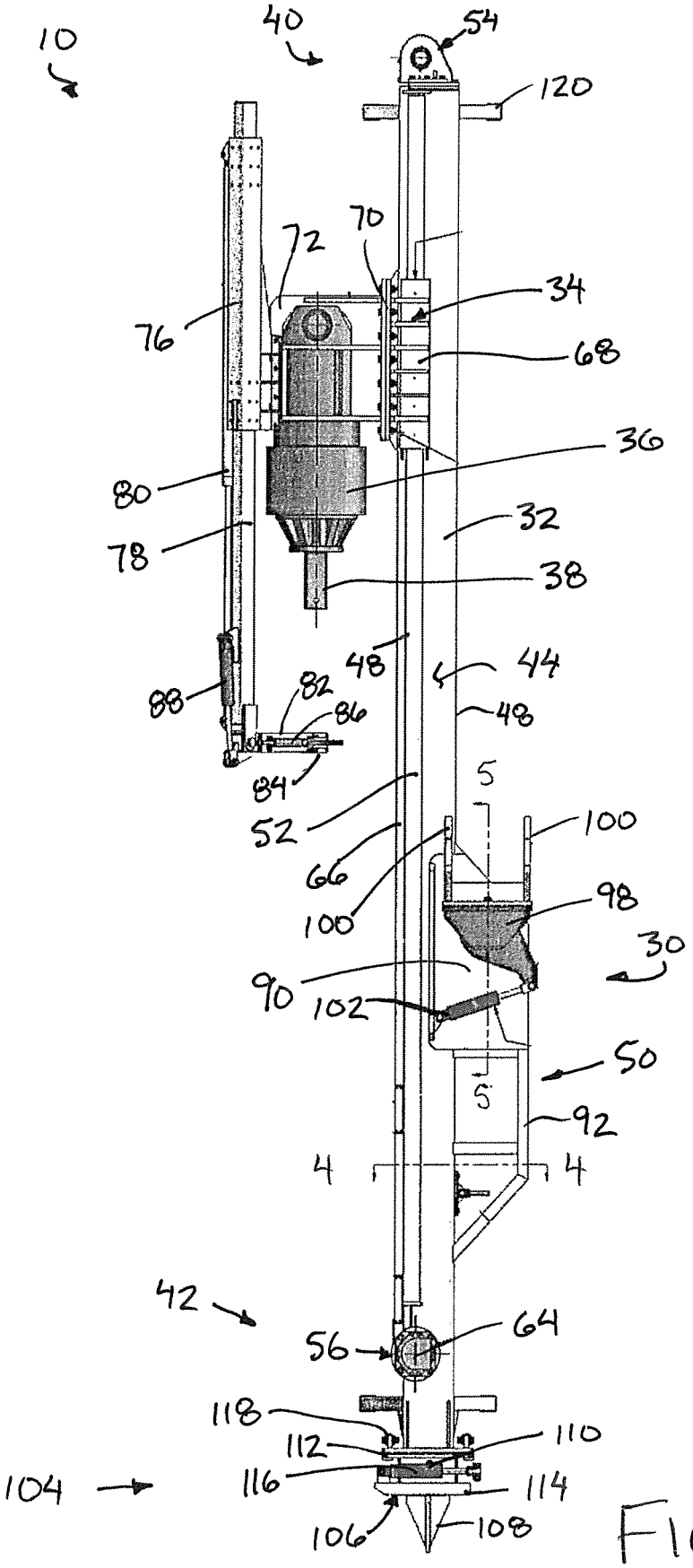
FIG. 3 is a rear elevational view of the screw pile driving apparatus.
Figure 4:
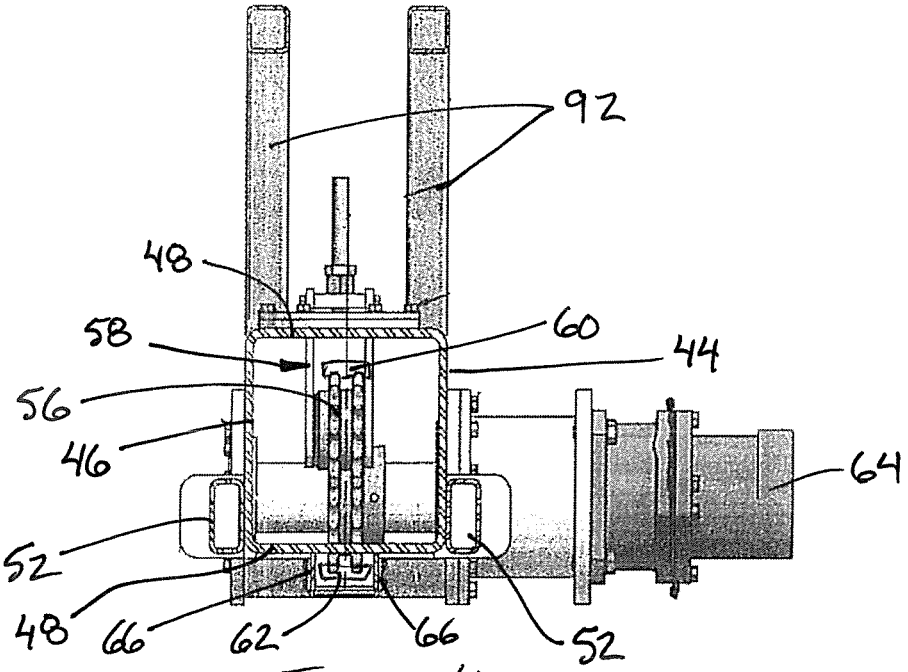
FIG. 4 is a sectional view along the line 4-4 in FIG. 3.
Figure 5:
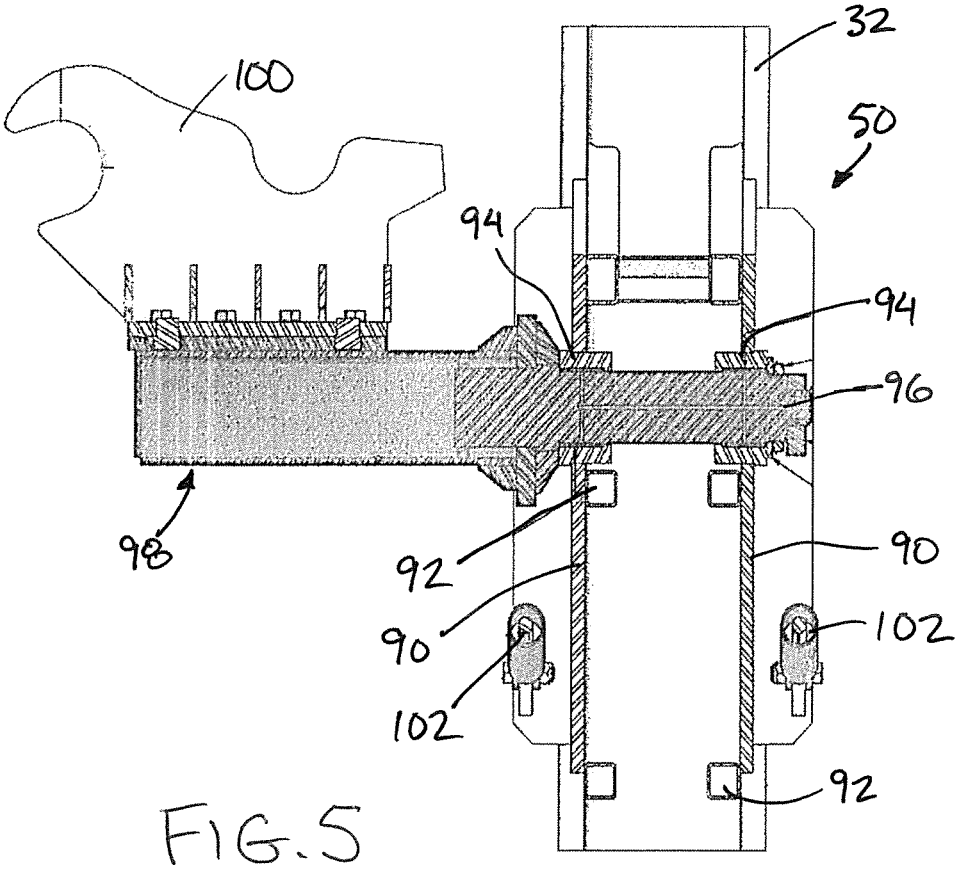
FIG. 5 is a sectional view along the line 5-5 in FIG. 3.

A protruding portion 72 of the frame of the carriage 34 is mounted on the bridge portion 70 to extend laterally outwardly from the mast in a second lateral direction which is diametrically opposite to the first lateral direction that the mounting frame 50 of the mounting arrangement protrudes from the mast 32. More particularly the protruding portion 72 extends radially outward relative to a longitudinal axis of the mast to lie generally perpendicular to the above noted forward axis extending between the rear and forward sides of the mast. The protruding portion 72 supports the rotary driver 36 thereon such that the rotary driver is similarly offset and spaced laterally outward in the second lateral direction from the mast. When a screw pile is suspended from the rotary output of the rotary driver, the screw pile is in turn supported by the protruding portion 72 to be also laterally offset to one side of the mast when viewed from the rear by an operator within the cab of the excavator 14 as shown in FIG. 3.

The bridge portion 70 of the carriage 34 is shaped to extend about the channel formed by the guard flanges 66 and that locates the outer run 62 of the drive chain therein. The bridge portion 70 is coupled in fixed and immovable relation to a respective portion of the outer run 62 of the driven chain 58 to ensure that the carriage 34 moves together with the drive chain for longitudinal sliding movement along the mast as the drive chain is rotated about the upper and lower gears by the drive motor 64.

The apparatus 10 further includes a pickup arrangement that is mounted on the carriage frame 34 to be movable along the mast together with the carriage frame. The pickup arrangement serves to pick up a screw pile from the ground and move the screw pile into alignment with the rotary output of the rotary driver 36. The pickup arrangement includes a sleeve 76 which is mounted at the outer end of the protruding portion 72 of the carriage frame farthest from the mast and at a rear side of the carriage frame 34 nearest to the excavator. The sleeve 76 thus lies parallel to the longitudinal axis of the mast at a rear corner offset in the second lateral direction relative to the mast. A post 78 is received within the sleeve 76 so as to be vertically slidable within the sleeve to protrude below the sleeve and the rotary output of the motor by varying amounts. A lift actuator 80 in the form of a linear hydraulic actuator is operatively connected between the post 78 and the sleeve 76 to longitudinally displace the post relative to the sleeve. The lift actuator 80 is driven by an auxiliary hydraulic circuit of the excavator as described above.

A pickup arm 82 of the pickup arrangement is mounted at the bottom end of the post 78 and supports a clamp 84 at the outer end thereof which is suitably arranged for clamping about the shaft of a screw pile in proximity to the top end of the pile. The clamp 84 is operated between open and closed positions by a suitable clamp actuator 86 in a form of a hydraulic actuator which is also operatively connected to the hydraulic system of the excavator for opening and closing the clamp. The pickup arm 82 is pivotally supported at an inner end on the bottom end of the post for relative pivotal movement about a lateral pivot axis lying within a plane that is perpendicular to the longitudinal axis of the mast. The clamp 84 is supported at an outer end of the pickup arm opposite to the inner end of the pickup arm that is pivotally coupled to the bottom end of the post.

A pickup actuator 88 is operatively connected between the pickup arm 82 and the post 78 to control displacement of the arm between first and second operating positions. In the first operating position, the pickup arm extends vertically downward in alignment with the post 78 to lie substantially parallel to the longitudinal axis of the mast together with the post. In this orientation, the clamp 84 is suitably arranged for clamping about the shaft of a pile which is horizontally oriented along the ground for example. In the second operating position, the pickup arm is pivoted upwardly from a vertical orientation to a horizontal orientation of the arm such that the clamp 84 at the inner end of the pickup arm is aligned generally coaxially with the rotary axis of the rotary output of the driver 36. In this manner, the shaft of a screw pile clamped within the clamp 84 is displaced from a horizontal orientation to a vertical orientation in coaxial alignment with the output of the rotary driver as the pickup arm is displaced from the first position to the second position.

The pickup actuator 88 can be configured in a neutral configuration in which the pickup arm is freely pivotal relative to the post 78 and the screw pile clamped within the pickup arm is merely freely suspended by gravity from the arm by the clamp 84. In this manner, the carriage can be initially positioned close to the ground so that the pickup arrangement can clamp onto a horizontal pile shaft lying on the ground. With the pickup actuator in a neutral configuration, upward displacement of the carriage along the mast will lift the top end of the screw pile together with the carriage while the screw pile is re-oriented towards a more upright orientation by being merely freely suspended by gravity from the free pivoting pickup arm 82. Once the carriage has been lifted to provide sufficient clearance for the screw pile to be vertically suspended from the rotary driver, the pickup actuator can be actuated to displace the pickup arm fully into the second position thereof for alignment of the screw pile with the output of the rotary driver and to allow the screw pile to be coupled non-rotatably relative to the rotary output for subsequent driving of the pile into the ground.

The mounting arrangement 30 which includes the mounting frame 50 described below, serves to couple the mast to the bucket mount 24 of the excavator while enabling relative pivotal movement between the mast 32 and the bucket mount 24 about a lateral tilt axis oriented in the forward direction of the mast. The lateral tilt axis is thus perpendicular to the third horizontal axis or bucket axis of the bucket mount 24 that pivots relative to the remainder of the boom assembly of the excavator. This enables inclination of the mast from vertical to be adjusted about two different axes that perpendicular to one another.

The mounting frame 50 generally includes two parallel plates 90 extending outward from the mast in the first lateral direction while being parallel to the longitudinal axis of the mast. The parallel plates are further supported by two side frames 92 comprised of respected frame members mounted to the two mounting plates 90 respectively. The mounting plate 90 of each side frame 92 supports a respective bushing member 94 therein in which the bushings 94 collectively define the lateral tilt axis of pivotal movement between the mast and the bucket mount 24. More particularly, the bushings 94 rotatably support a pivot shaft 96 of the mounting arrangement.

The pivot shaft 96 supports a tilt frame 98 mounted thereon so that the tilt frame 98 is fixed and immovable relative to the pivot shaft. The tilt frame 98 supports two brackets 100 thereon in which the brackets comprise parallel plates with suitable hooks and recesses formed thereon that are used for forming a releasable connection to the bucket mount 24 of the excavator. The brackets 100 are bolted onto the tilt frame 98 so as to be interchangeable with different shapes of brackets that are suitable for mounting with different types of bucket mounts 24 associated with different manufacturers respectively.

The pivot coupling, between the pivot shaft 96 of the tilt frame 98 and the bushings 94 on the mounting frame 50, defines the lateral tilt axis that is parallel to the forward direction of the mast so that the mast can be tilted side to side within a plane that is perpendicular to the tilt axis and parallel to the rear side of the mast respectively. A pair of tilt actuators 102 are operatively connected between the mounting frame 50 and the tilt frame 98 to control the inclination of the mast from vertical about the tilt axis. The tilt actuators comprise hydraulic actuators which can be coupled to the hydraulic system of the excavator to be controlled by operator controls of the excavator as described above.

When the tilt actuators 102 are locked in orientation, and the tilt frame is coupled fixed and immovably with the bucket mount 24 of the excavator, the mast moves with the bucket mount about the third horizontal axis or bucket axis of the bucket mount relative to the boom of the excavator. This allows control of the tilt or inclination of the mast from vertical within a second plane oriented in the forward direction of the mast. The bucket axis thus defines a second tilt axis that is perpendicular to the first tilt axis defined by the pivot shaft 96. The first and second tilt axes collectively allow the vertical orientation of the mast to be controlled in two directions to precisely locate the mast in a vertical orientation regardless of the slope of the ground upon which the excavator is supported.

The apparatus 10 further includes a ground supporting arrangement forming a bottom end portion 104 of the mast. The bottom end portion 104 includes a base plate 106 supported at the bottom end of the mast and mounting a ground spike 108 on the bottom end thereof which is arranged to be penetrated into the ground. The ground spike is fixed relative to the base plate 106 to protrude perpendicularly downwardly from the base plate and to taper downwardly to a pointed end for penetration into the ground.

The base plate 106 is supported relative to the remainder of the mast for translating movement along two translating axes that are perpendicular to one another and that lie within a common plane perpendicular to the longitudinal axis of the mast. The base plate 106 is supported relative to the bottom end of the mast by an intermediate frame 110 coupled between the base plate and the mast. More particularly, the bottom end of the mast includes two tracks 112 which are parallel and spaced apart within a plane that is perpendicular to the longitudinal axis of the mast at the bottom end of the mast. The intermediate frame is coupled onto the two tracks 112 for relative sliding movement about a first translating axis.

The intermediate frame similarly comprises two tracks 114 which are parallel to one another and spaced apart within a plane that is perpendicular to the longitudinal axis of the mast at a location below the tracks 112 to define the second translating axis that is perpendicular to the first translating axis. The base plate 106 is coupled to the tracks 114 for relative sliding movement along the second translating axis.

A set of first translating actuators 116 are operatively connected between the bottom of the mast and the intermediate frame to control sliding movement along the first translating axis. Similarly, two second translating actuators 118 are operatively connected between the intermediate frame and the base plate to control sliding movement along the second translating axis. The translating actuators comprise hydraulic actuators operatively connected to the hydraulic systems of the excavator for control of the translating movement using excavator controls as described above.

In a neutral position of the base plate, the ground spike 108 is centred relative to the mast along both translating axes. The translating actuators are arranged to drive relative movement between the components they are connected to in two opposing directions along the respective translating axis from the neutral position. In this manner, once the ground spike has been penetrated into the ground, the bottom end of the mast can be shifted from the neutral position in either one of two opposing directions along each of the first and second translating axes to fine-tune the alignment of the mast and/or screw pile with a target location for the driving of the pile into the ground as desired.

Turning now to FIGS. 11 to 16, the use of the screw pile driving apparatus 10 will now be described. The apparatus 10 is initially mounted on the bucket mount of the work vehicle in place of a conventional excavator bucket. Various hydraulic output circuits of the hydraulic system of the work vehicle are connected to the hydraulic actuators of the apparatus 10 for controlling the operation of the apparatus.

Figure 11:
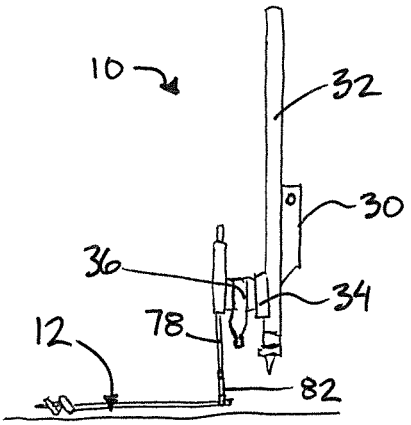
FIGS. 11 through 16 are schematic representations of the apparatus illustrating the steps of picking up and driving a screw pile into the ground using the screw pile driving apparatus.
Figure 12:
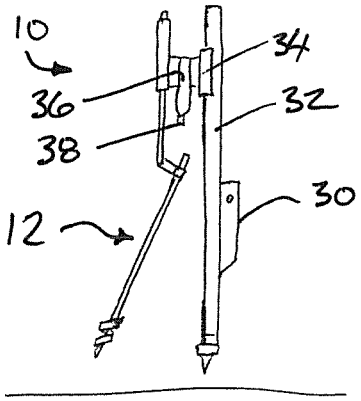
Figure 13:
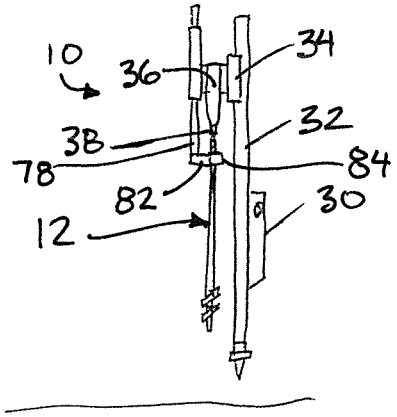

The bucket actuator for controlling the tilt of the bucket mount relative to the boom is adjusted, as well as the tilt actuator, to adjust the inclination of the mast from vertical about two different axes to support the mast in a vertical orientation. The process of driving a screw pile into the ground begins by positioning the carriage at the bottom of the mast so that the pickup arm can be oriented in the first position for clamping onto a screw pile laying on the ground adjacent a top end of the pile as shown in FIG. 11. With the clamp of the pickup arrangement secured about the shaft of the screw pile, the carriage can be raised along the mast while the pickup arm with the screw pile clamped therein remains freely suspended in a neutral position of the pickup actuator as shown in FIG. 12. Once sufficient clearance is provided below the carriage for receiving the screw pile in a vertical orientation, the pickup arm is actuated into the second position to align the screw pile coaxially with the output of the rotary driver. The post of the pickup arrangement can then be adjusted in height to couple the top end of the screw pile with the rotary output of the rotary driver as shown in FIG. 13.

Figure 14:
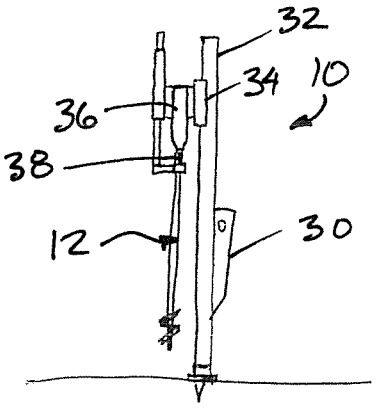
Figure 15:
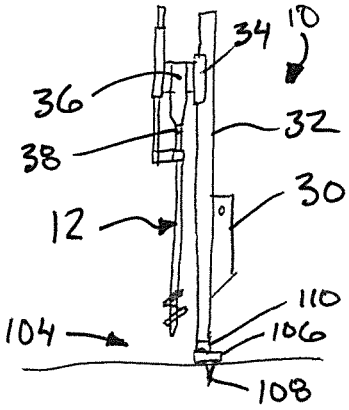

The operator then positions the mast in a vertical orientation directly adjacent a target location for the screw pile so that the screw pile is coaxially aligned with the target location. The mast is then lowered towards the ground so that the ground spike is penetrated into the ground as shown in FIG. 14. In the event that the ground spike encounters an obstacle such as a stone in the ground which slightly displaces the mast to one side such that the screw pile is no longer aligned with the target location, the operator can use the translating actuators to re-align the screw pile coaxially with the target location while the ground spike remains penetrated in the ground as shown in FIG. 15. Control of the bucket actuator and the tilt actuator can also be further adjusted to ensure that the mast remains vertical prior to penetration of the screw pile into the ground.

The carriage can then be lowered until the screw pile engages the surface of the ground. The clamp of the pickup arrangement can be relaxed or reduced in clamping force to enable the screw pile to be rotatable within the clamp while still provide some guidance and support to the shaft of the screw pile by the clamp during initial penetration of the screw pile into the ground. Alternatively, once the screw pile is engaged with the ground, the clamp of the pickup arrangement can be fully disengaged from the screw pile. Once support by the pickup arrangement is no longer required, the pickup arrangement can be raised in elevation relative to the rotary driver so that the pickup arrangement does not interfere with penetration of the pile into the ground.

Figure 16:
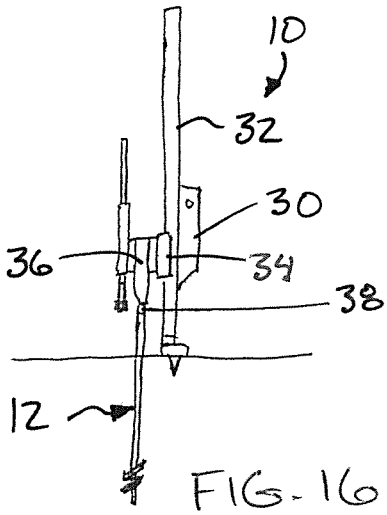

To initially insert the screw pile into the ground, some down pressure is provided using the carriage motor while initially rotating the screw pile using the rotary driver until the helical flighting at the bottom end of the screw pile begins to engage into the ground. Once the helical flighting at the bottom end of the screw pile is at least partly penetrated into the ground, continued rotation of screw pile using the rotary driver is sufficient to pull the screw pile further into the ground without further downward pressure being needed on the part of the carriage motor. Accordingly, the carriage motor for driving rotation of the drive chain to displace the carriage is shifted into a neutral configuration allowing free movement of the carriage along the mast. Continued rotation of the screw pile using the rotary driver as shown in FIG. 16 is then sufficient to drive the screw pile into the ground until the screw pile is fully penetrated to the desired depth.

Figure 6:
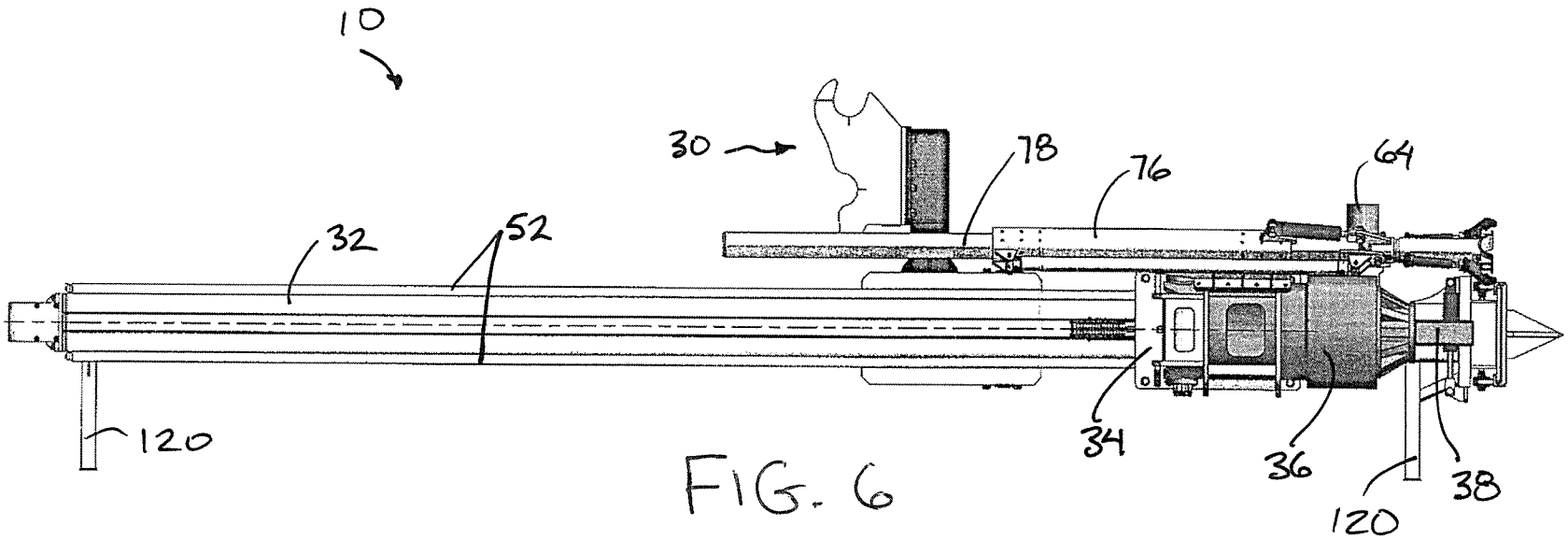
FIG. 6 is a side view of the screw pile driving apparatus shown supported on legs in a horizontal storage orientation.
Figure 7:
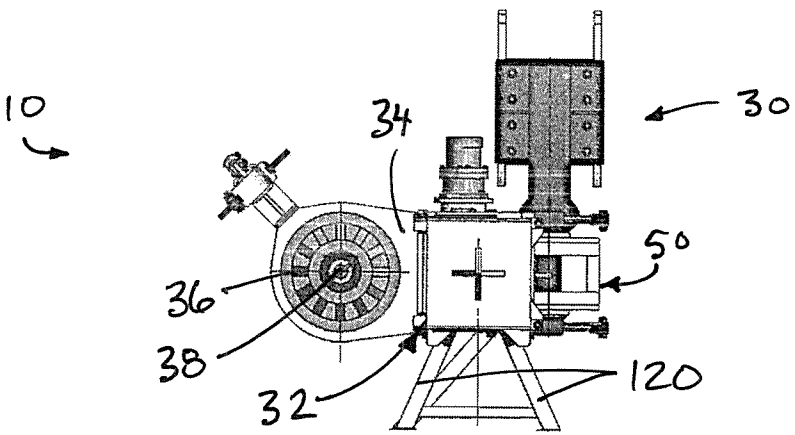
FIG. 7 is an end view of the apparatus in the storage orientation according to FIG. 6.
Figure 8:
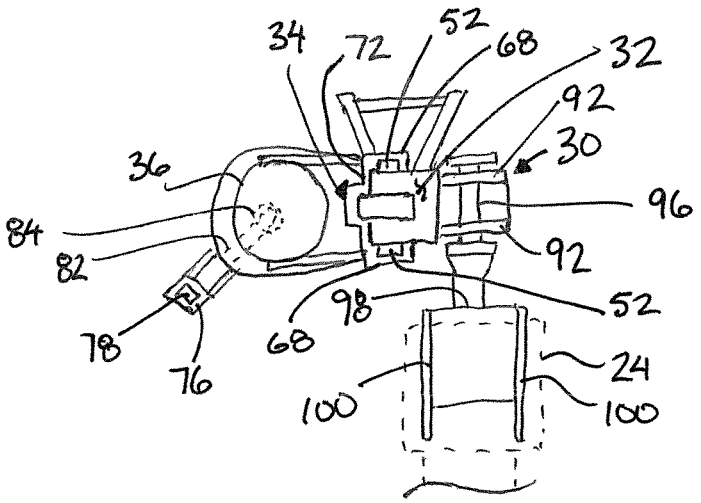
FIG. 8 is a top plan view of the apparatus in the working orientation.
Figure 9:
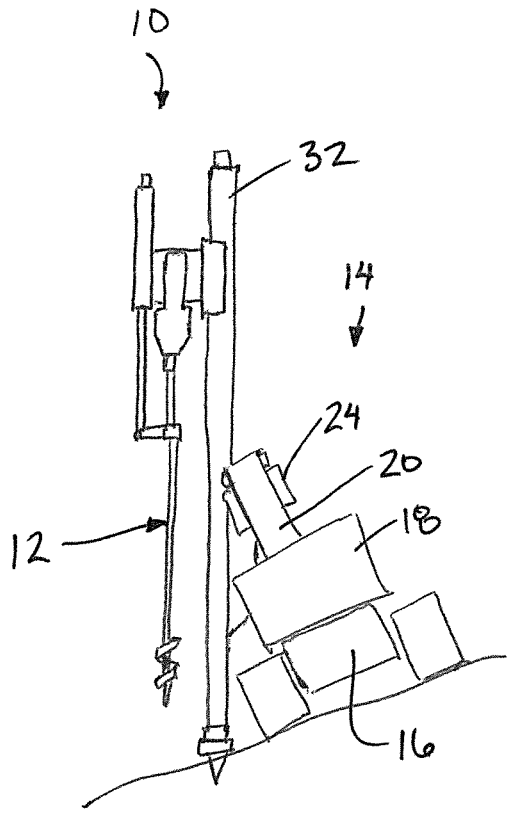
FIG. 9 is a schematic rear view of the apparatus shown supported on an excavator.
Figure 10:
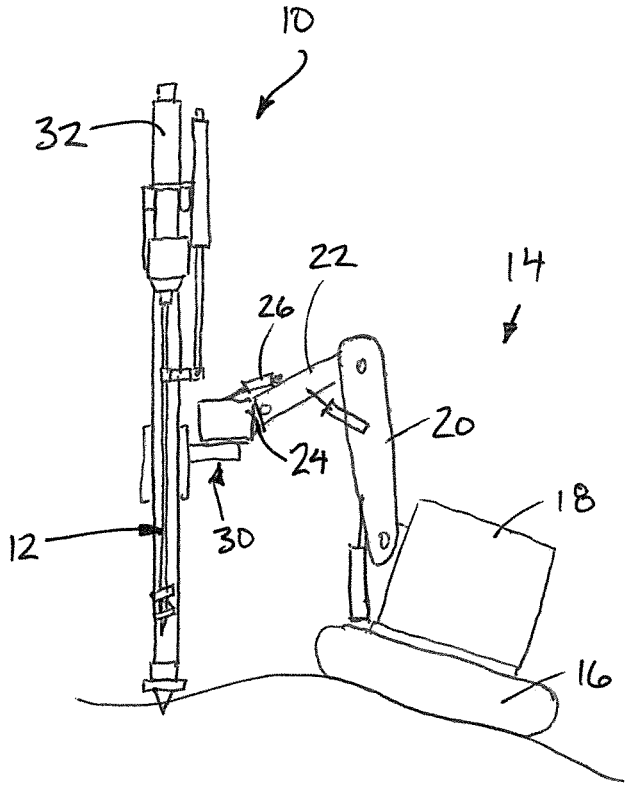
FIG. 10 is a schematic side view of the apparatus shown supported on the excavator.

When the apparatus 10 is not in use and is detached from the work vehicle, the apparatus can be supported on a suitable ground surface using a set of legs 120 as shown in FIGS. 6 and 7. The legs 120 are provided in two sets that are supported on the mast and protrude in a common lateral direction from the mast at spaced apart positions along the mast at opposing top and bottom ends of the mast. Each set comprises two legs which are lateral spaced apart so as to be arranged support the mast for storage extending along the ground with the front wall 46 being located at the bottom side approximately parallel to the ground at a location spaced upwardly from the ground when the legs are engaged upon the ground. The common lateral direction that the legs 120 protrude from the mast is diametrically opposite from the mounting arrangement 30 relative to the longitudinal axis of the mast.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A screw pile driving apparatus for use with a boom of a work vehicle for driving a screw pile into ground for receiving the screw pile, the apparatus comprising:

a mounting arrangement arranged for releasable attachment to the boom of the work vehicle;

a mast supported on the mounting arrangement so as to be arranged to be vertically oriented when supported on the work vehicle;

a carriage supported for sliding movement along a longitudinal axis of the mast;

a rotary driver supported on the carriage for movement along the mast with the carriage, the rotary driver having a rotary output arranged to be releasably coupled to the screw pile for driving rotation of the screw pile relative to the ground;

a ground supporting arrangement arranged to secure the bottom end of the mast relative to the ground; and a coupling arrangement supporting the ground supporting arrangement on the bottom end of the mast such that the ground supporting arrangement is adjustable relative to the mast along at least one translating axis oriented perpendicularly to the longitudinal axis of the mast.

2. The apparatus according to claim 1 further comprising:

a tilt pivot coupling the mast pivotally relative to the mounting arrangement about a lateral tilt axis whereby inclination of the mast can be adjusted within a first plane perpendicular to the lateral tilt axis; and a tilt actuator operatively connected between the mounting arrangement and the mast to controllably adjust the inclination of the mast relative to the mounting arrangement about the lateral tilt axis.

3. The apparatus according to claim 2 further comprising:

the mounting arrangement being arranged to be mounted on a bucket mount of the work vehicle that is pivotal about a bucket axis relative to the boom;

the mounting arrangement being arranged to be secured to the bucket mount so as to be pivotal with the bucket mount relative to the boom about the bucket axis; and the mounting arrangement orienting the lateral tilt axis of the mast perpendicularly to the bucket axis.

4. The apparatus according to claim 2 further comprising:

the mounting arrangement being arranged to be mounted on a bucket mount of the work vehicle that is pivotal about a bucket axis relative to the boom;

the mounting arrangement being arranged to be secured to the bucket mount so as to be pivotal with the bucket mount relative to the boom about the bucket axis; and the mounting arrangement supporting the mast to be laterally offset from the bucket mount in a direction of the bucket axis.

5. The apparatus according to claim 1 wherein the ground supporting arrangement comprises: a ground spike arranged to be penetrated into the ground.

6. The apparatus according to claim 1 wherein said at least one translating axis comprises two translating axes oriented perpendicularly to one another.

7. The apparatus according to claim 1 wherein the coupling arrangement includes a translating actuator associated with said at least one translating axis, the translating actuator being arranged to displace the ground supporting arrangement in either one of two opposing directions along the translating axis from a neutral position of the ground supporting arrangement relative to the mast.

8. The apparatus according to claim 1 further comprising a carriage driver arranged to drive upward movement of the carriage along the mast when the screw pile is supported on the carriage, the carriage driver including a neutral position enabling free movement of the carriage relative to the mast when the screw pile is driven into the ground using the rotary driver.

9. The apparatus according to claim 8 wherein the carriage driver comprises:

a driven chain in the form of an endless loop in operative connection between an upper gear rotatably supported in proximity to a top end of the mast and a lower gear rotatably supported in proximity to a bottom end of the mast;

a drive motor operatively connected to one of the upper gear, the lower gear or the driven chain to drive rotation of the driven chain about the upper and lower gears; and the carriage being coupled to the driven chain for movement of the carriage along the mast together with rotation of the driven chain about the upper and lower gears.

10. The apparatus according to claim 1 further comprising a pickup arrangement supported for movement along the mast, the pickup arrangement being arranged to clamp onto the screw pile independently of the rotary output of the rotary drive such that the screw pile is movable along the mast together with the pickup arrangement.

11. The apparatus according to claim 10 wherein the pickup arrangement is supported on the carriage so as to be movable along the mast together with the carriage.

12. The apparatus according to claim 1 further comprising a set of legs supported on the mast and protruding in a common lateral direction from the mast at spaced apart positions along the mast so as to be arranged to support the mast for storage extending along the ground at a location spaced upwardly from the ground when the legs are engaged upon the ground.

13. The apparatus according to claim 12 wherein said common lateral direction that the legs protrude from the mast is diametrically opposite from the mounting arrangement relative to the longitudinal axis of the mast.

14. The apparatus according to claim 1 further comprising an inclination sensor arrangement supported on the mast and arranged to indicate to an operator an inclination of the mast relative to a vertical axis about two inclination axis oriented perpendicular to one another and the vertical axis.

15. The apparatus according to claim 1 wherein the mounting arrangement is arranged to support a rear side of the mast facing the work vehicle, the carriage being supported on the mast so as to be laterally offset to one side of the mast in an offset direction oriented transversely to an imaginary horizontal axis extending from the rear side to a front side of the mast.

16. A screw pile driving apparatus for use with a boom of a work vehicle for driving a screw pile into ground for receiving the screw pile, the apparatus comprising:

a mounting arrangement arranged for releasable attachment to the boom of the work vehicle;

a mast supported on the mounting arrangement so as to be arranged to be vertically oriented when supported on the work vehicle;

a carriage supported for sliding movement along a longitudinal axis of the mast;

a rotary driver supported on the carriage for movement along the mast with the carriage, the rotary driver having a rotary output arranged to be releasably coupled to the screw pile for driving rotation of the screw pile relative to the ground;

a tilt pivot coupling the mast pivotally relative to the mounting arrangement about a lateral tilt axis whereby inclination of the mast can be adjusted within a first plane perpendicular to the lateral tilt axis; and a tilt actuator operatively connected between the mounting arrangement and the mast to controllably adjust the inclination of the mast relative to the mounting arrangement about the lateral tilt axis;

wherein the mounting arrangement is arranged to be mounted on a bucket mount of the work vehicle that is pivotal about a bucket axis relative to the boom;

wherein the mounting arrangement is arranged to be secured to the bucket mount so as to be pivotal with the bucket mount relative to the boom about the bucket axis; and wherein the mounting arrangement supports the mast to be laterally offset from the bucket mount in a direction of the bucket axis.

17. A screw pile driving apparatus for use with a boom of a work vehicle for driving a screw pile into ground for receiving the screw pile, the apparatus comprising:

a mounting arrangement arranged for releasable attachment to the boom of the work vehicle;

a mast supported on the mounting arrangement so as to be arranged to be vertically oriented when supported on the work vehicle;

a carriage supported for sliding movement along a longitudinal axis of the mast;

a rotary driver supported on the carriage for movement along the mast with the carriage, the rotary driver having a rotary output arranged to be releasably coupled to the screw pile for driving rotation of the screw pile relative to the ground; and a pickup arrangement supported for movement along the mast, the pickup arrangement being arranged to clamp onto the screw pile independently of the rotary output of the rotary drive such that the screw pile is movable along the mast together with the pickup arrangement;

wherein the pickup arrangement is supported on the carriage so as to be movable along the mast together with the carriage; and wherein at least one of:

(a) the pickup arrangement is slidable relative to the carriage in a sliding direction parallel to the longitudinal axis of the mast and the pickup arrangement further comprising a lift actuator arranged to lift the pickup arrangement relative to the carriage; and (b) the pickup arrangement comprises (i) a pickup arm arranged to coupled in fixed relation to the screw pile, the pickup arm being pivotal about a laterally oriented pickup axis relative to the carriage so as to be movable between a first position arranged to be coupled to the screw pile in a horizontal orientation of the screw pile and a second position arranged to be coupled to the screw pile in a vertical orientation of the screw pile, and (ii) a pickup actuator arranged to drive displacement of the pickup arm from the first position to the second position.

18. The apparatus according to claim 17 wherein the pickup arrangement is slidable relative to the carriage in a sliding direction parallel to the longitudinal axis of the mast, the pickup arrangement further comprising a lift actuator arranged to lift the pickup arrangement relative to the carriage.

19. The apparatus according to claim 17 wherein the pickup arrangement comprises:

(i) a pickup arm arranged to coupled in fixed relation to the screw pile, the pickup arm being pivotal about a laterally oriented pickup axis relative to the carriage so as to be movable between a first position arranged to be coupled to the screw pile in a horizontal orientation of the screw pile and a second position arranged to be coupled to the screw pile in a vertical orientation of the screw pile; and (ii) a pickup actuator arranged to drive displacement of the pickup arm from the first position to the second position.

* * * * *